US006158230A

United States Patent [19]

Katsuki

[11] Patent Number: 6,158,230

[45] Date of Patent: Dec. 12, 2000

[54] CONTROLLER FOR AIR CONDITIONER

[75] Inventor: Hikaru Katsuki, Gunma-ken, Japan

[73] Assignee: Sanyo Electric Co., Ltd., Ohsaka-fu, Japan

[21] Appl. No.: 09/271,738

[22] Filed: Mar. 18, 1999

[30] Foreign Application Priority Data

Mar. 30, 1998 [JP] Japan ..... 10-083718

[51] Int. Cl.[7] ..... F24F 11/00

[52] U.S. Cl. ..... 62/126; 62/230; 361/22

[58] Field of Search ..... 62/125, 126, 127, 62/129, 130, 228.1, 230; 361/22, 23, 24, 30, 31, 33

[56] References Cited

U.S. PATENT DOCUMENTS

| | | | |
|---|---|---|---|
| 4,307,775 | 12/1981 | Saunders et al. | 62/127 X |
| 4,557,114 | 12/1985 | Kato et al. | 361/22 X |
| 4,912,936 | 4/1990 | Denpou | 62/230 X |
| 5,209,076 | 5/1993 | Kauffman et al. | 62/126 |
| 5,268,832 | 12/1993 | Kandatsu | 363/95 |
| 5,303,560 | 4/1994 | Hanson et al. | 62/230 X |
| 5,454,230 | 10/1995 | Janke et al. | 62/126 |

FOREIGN PATENT DOCUMENTS

| | | |
|---|---|---|
| 0 653 692 A2 | 5/1995 | European Pat. Off. . |
| 0 780 750 A2 | 6/1997 | European Pat. Off. . |
| 0 792 002 A2 | 8/1997 | European Pat. Off. . |
| 0 793 160 A1 | 9/1997 | European Pat. Off. . |
| 8005132 | 1/1996 | Japan . |
| 8085335 | 4/1996 | Japan . |
| 8276730 | 10/1996 | Japan . |
| 9159290 | 6/1997 | Japan . |

*Primary Examiner*—Harry B. Tanner

*Attorney, Agent, or Firm*—Knobbe, Martens, Olson & Bear, LLP

[57] ABSTRACT

When an air-conditioning is started, a determination is made as to whether a power relay is run so as to keep a compressor in a power-on state. When the power relay is in the power-on state, the running current of the power relay is detected. At this point, if the current value does not reach to a predetermined value, it is determined that the compressor is stopped in an exterior unit for protection.

11 Claims, 8 Drawing Sheets

CONTROLLER FOR AIR CONDITIONER

BACKGROUND OF THE INVENTION

1. Field of the Invention

The present invention relates to a controller for an air conditioner, and more particularly, to a controller for an air conditioner which has a compressor of a constant speed drive type.

2. Description of the Related Art

Among air conditioners for effecting air-conditioning of an interior of a room, what is called a constant-speed type circulates refrigerant while driving a compressor to rotate at a constant rotational frequency. Further, one type of air conditioner is called a separate type, which is divided into an interior unit installed inside the room and an exterior unit installed outside the room.

In the constant-speed separate type air conditioner, a compressor is controlled in such a manner that it is turned on or off in accordance with necessity. In other words, the compressor is run or stopped when a microcomputer provided in the interior unit turns a power relay for supplying electric power to the compressor on or off, thereby controlling the compression of the refrigerant and the circulation of the refrigerant in a refrigerating cycle.

However, in such an air conditioner, if a cross flow fan is run at the start of a heating, cold air is blown out in the interior of the room because the temperature of a heat exchanger in the interior unit is as low as the room temperature. In order to prevent cold air from being blown out at the start of the heating like this, the temperature of the heat exchanger in the interior unit is measured, and after the temperature of the heat exchanger has risen to a certain degree (for example, approximately 25° C.), the cross flow fan is rotated firstly at low speed so as to gently blow out air. Subsequently, when the temperature of the heat exchanger of the interior unit has risen sufficiently and exceeds a predetermined temperature (for example, approximately 35° C.), the process proceeds to the heating with a set amount of air.

In this way, the air conditioner controls the amount of air to be blown out in accordance with the rise of the temperature of the heat exchanger during the heating. Then, after the temperature of the heat exchanger has exceeded the predetermined temperature, the air conditioner continues the heating while always blowing out a set amount of the heated air.

On the other hand, in the exterior unit, a protection running that forces the compressor to stop is effected when the compressor is overloaded or the outside air temperature goes down regardless of a power-on/off state of the power relay of the interior unit.

However, constant-speed type air conditioners usually do not have circuits which can detect in the interior unit a protective running of the exterior unit. For this reason, the cross flow fan continues to rotate with a set amount of air even when the compressor has stopped running. Thus, for example, during the heating, the temperature of the heat exchanger goes down gradually, thereby casing a problem that cold air or air that is felt to be cold is blown out into the interior of the room.

In the meantime, in the exterior unit, the protection running that forces the compressor to stop is effected. The forced stop of the compressor is effected not only when the compressor motor is overloaded, but also when the outside air temperature goes down during the heating as it becomes impossible to demonstrate a sufficient heating capability.

This type of forced stop of the compressor interrupts the supply of the electric power to the compressor motor regardless of an on/off signal of the power relay from the microcomputer of the interior unit.

However, particularly among constant-speed type air conditioners, there are some air conditioners that eliminate as many functions as possible in order to reduce the price of the product. Further, some of them even simplify the connection between the interior unit and the exterior unit and eliminate a signal conductor for feeding the running conditions of the exterior unit back to the interior unit. In that case, the forced stop of the compressor in the exterior unit cannot be detected easily on the interior unit side. For this reason, for example, during the heating, the cross flow fan of the interior unit is kept running although the compressor of the exterior unit has been stopped by the protection running, thereby raising problems such as cold air being blown out from the interior unit.

SUMMARY OF THE INVENTION

The present invention was made in view of the aforementioned, and an object of the present invention is to provide a controller for an air conditioner in which an interior unit can, with a simple structure, detect the stopping of a compressor without an increase in an amount of wiring between an interior unit and an exterior unit.

A first aspect of the present invention in order to solve the above problem is an air conditioner which not only constructs refrigerating cycle by utilizing at least a constant-speed type compressor, a heat exchanger on the side of users, an expansion device, a heat exchanger on the side of a heat source but also mounts said devices, which constructs the refrigerating cycle, by dividing said devices into an exterior unit and an interior unit so that it is constructed in such a manner that the stopping/running of said compressor mounted on said exterior unit is run by opening or closing of a contact point of a power relay mounted on said exterior unit, said interior unit comprising: compressor control means for carrying out the opening and closing of said contact point by controlling an electric current to an exciting coil of said power relay; electric current detecting means for detecting the electric current passing said exciting coil; a control circuit for determining if there is an abnormality of the exterior unit by a comparison between a detected value of the electric current detecting means and a predetermined value; and said exterior unit comprising protecting means for interrupting an electric current passage to said exciting coil when it is determined that there is an abnormality of the exterior unit.

According to the present invention, the compressor control means drives the power relay so that the compressor is run. The protecting means forces the compressor to stop by interrupting the electric current to the exciting coil of the power relay.

When the running of the protecting means interrupts the electric current to the exciting coil of the power relay, the value detected by the electric current detecting means varies. The control circuit determines whether or not the compressor has been stopped by the running of the protecting means on the basis of the change in the value of the electric current from the electric current detecting means.

Thus, the stopping of the compressor can be detected by a simple structure without specially providing wiring and the like for detecting the stopping of the compressor between the interior unit and the exterior unit.

DESCRIPTION OF THE PREFERRED EMBODIMENTS

An embodiment of the present invention will be described hereinafter with reference to the accompanying drawings.

Figure 1:
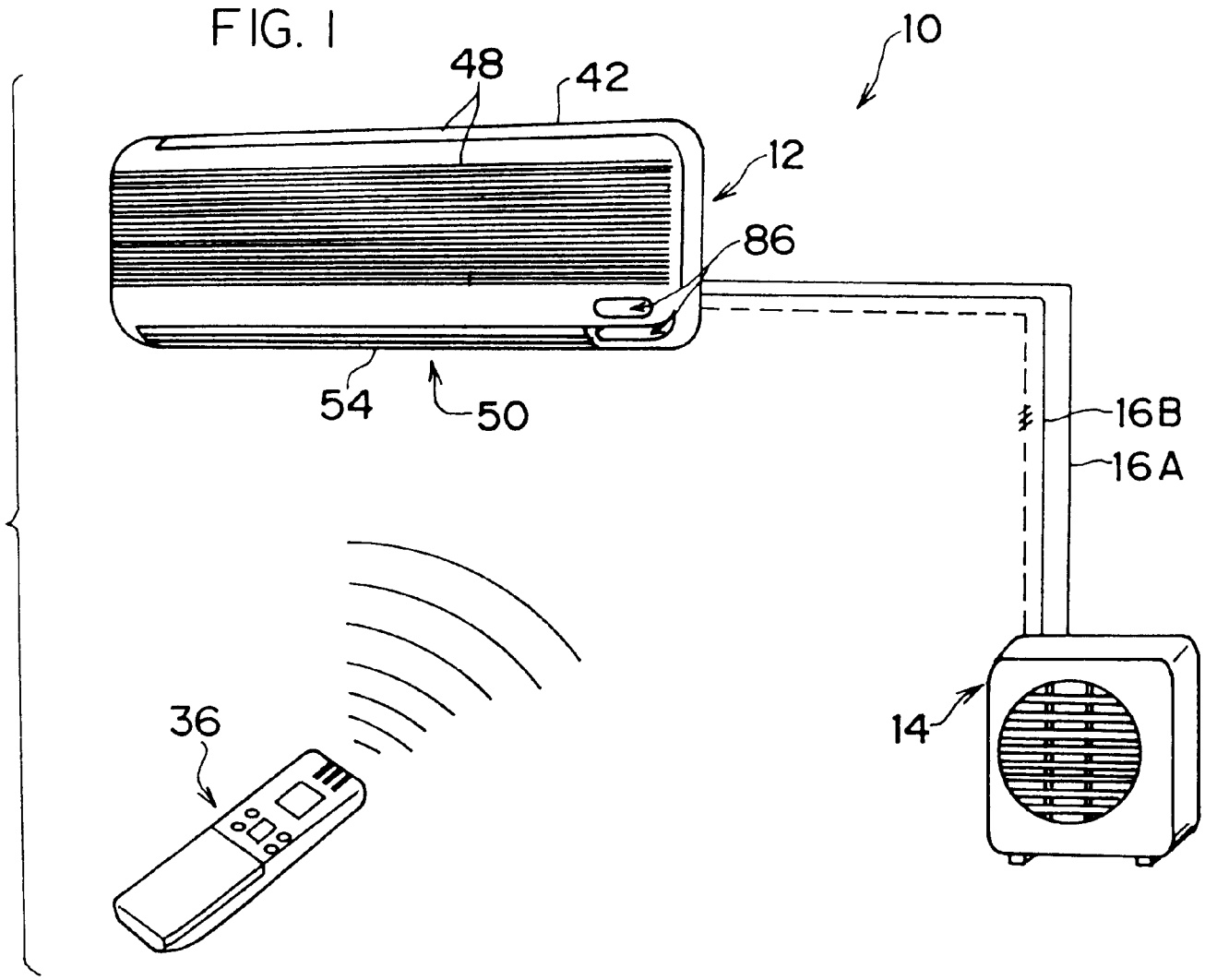
FIG. 1 is a schematic structural view of an air conditioner applied to the present embodiment.

As shown in FIG. 1, an air conditioner 10 applied to the present embodiment is a separate type that is divided into an interior unit 12 installed inside a room to be air-conditioned and an exterior unit 14 installed outside the room. An air-conditioning is effected while the interior unit 12 controls the exterior unit 14 in accordance with the running conditions such as a running mode, a set temperature, and the like set by operation of a remote control switch 36.

Figure 2:
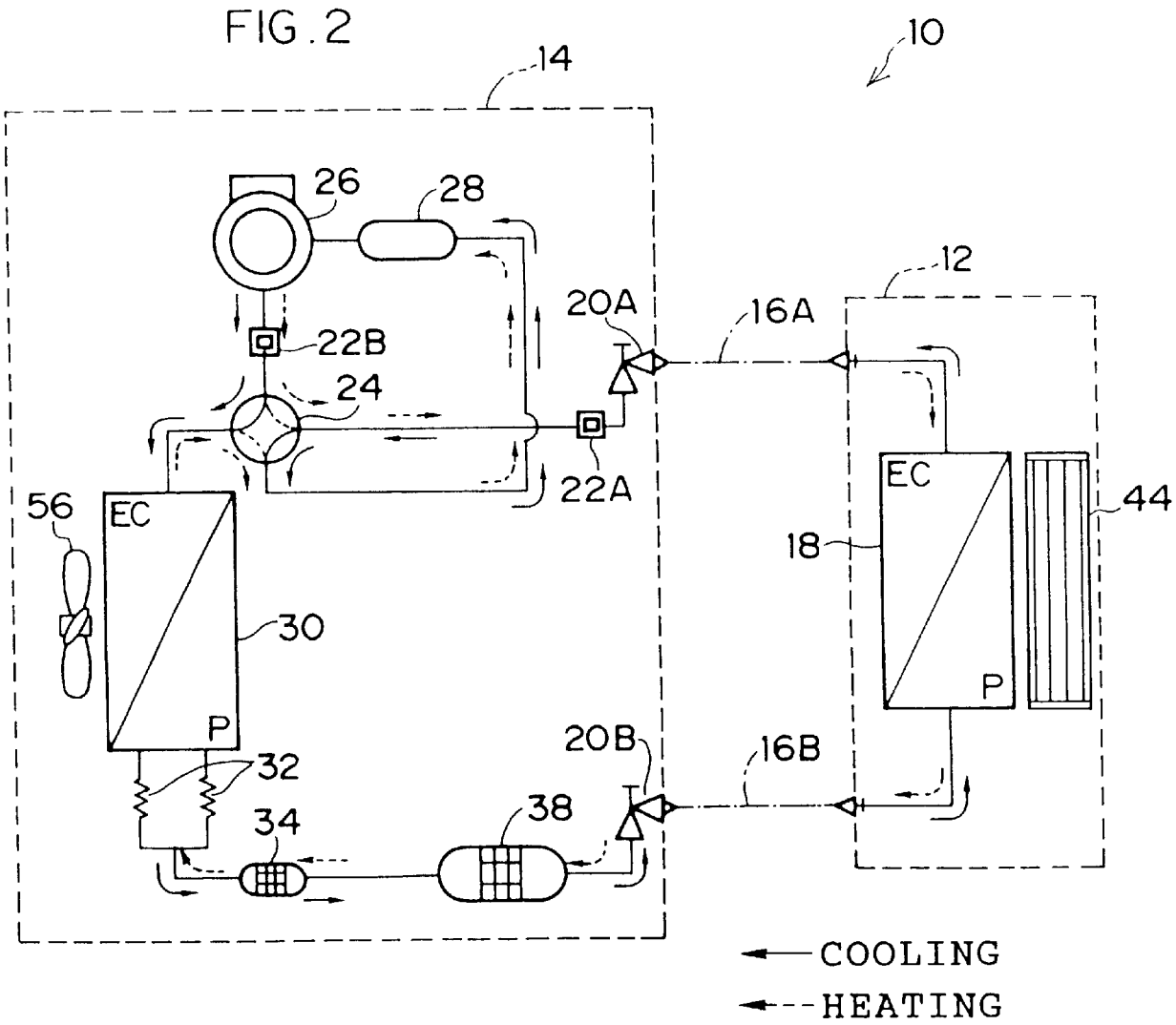
FIG. 2 is a schematic structural view illustrating a refrigerating cycle of an air conditioner applied to the present embodiment.

FIG. 2 shows an outline of a refrigerating cycle formed between the interior unit 12 and the exterior unit 14 of the air conditioner 10. Between the interior unit 12 and the exterior unit 14, a wide refrigerant pipe 16A and a narrow refrigerant pipe 16B are provided as a pair for circulating refrigerant. Respective one ends of the refrigerant pipes 16A and 16B are connected to a heat exchanger 18 provided in the interior unit 12.

The other end of the refrigerant pipe 16A is connected to a valve 20A of the exterior unit 14. The valve 20A is connected to a four-way valve 24 via a muffler 22A. An accumulator 28 and a muffler 22B, each of which is connected to a compressor 26, are connected to the four-way valve 24. Further, a heat exchanger 30 is provided in the exterior unit 14. One end of the heat exchanger 30 is connected to the four-way valve 24, and the other end is connected to a valve 20B via a capillary tube 32, a strainer 34, and a modulator 38. The other end of the refrigerant pipe 16B is connected to the valve 20B. In this way, a closed refrigerant circulating path forming a refrigerating cycle between the interior unit 12 and the exterior unit 14 is formed.

In the air conditioner 10, the running mode can be switched to a cooling mode (including a dry mode) or a heating mode by switching the four-way valve 24. The flow of the refrigerant in the cooling mode (cooling) and the flow of the heating mode (heating) are indicated by solid arrows and dotted arrows, respectively, in FIG. 2.

Figure 3:
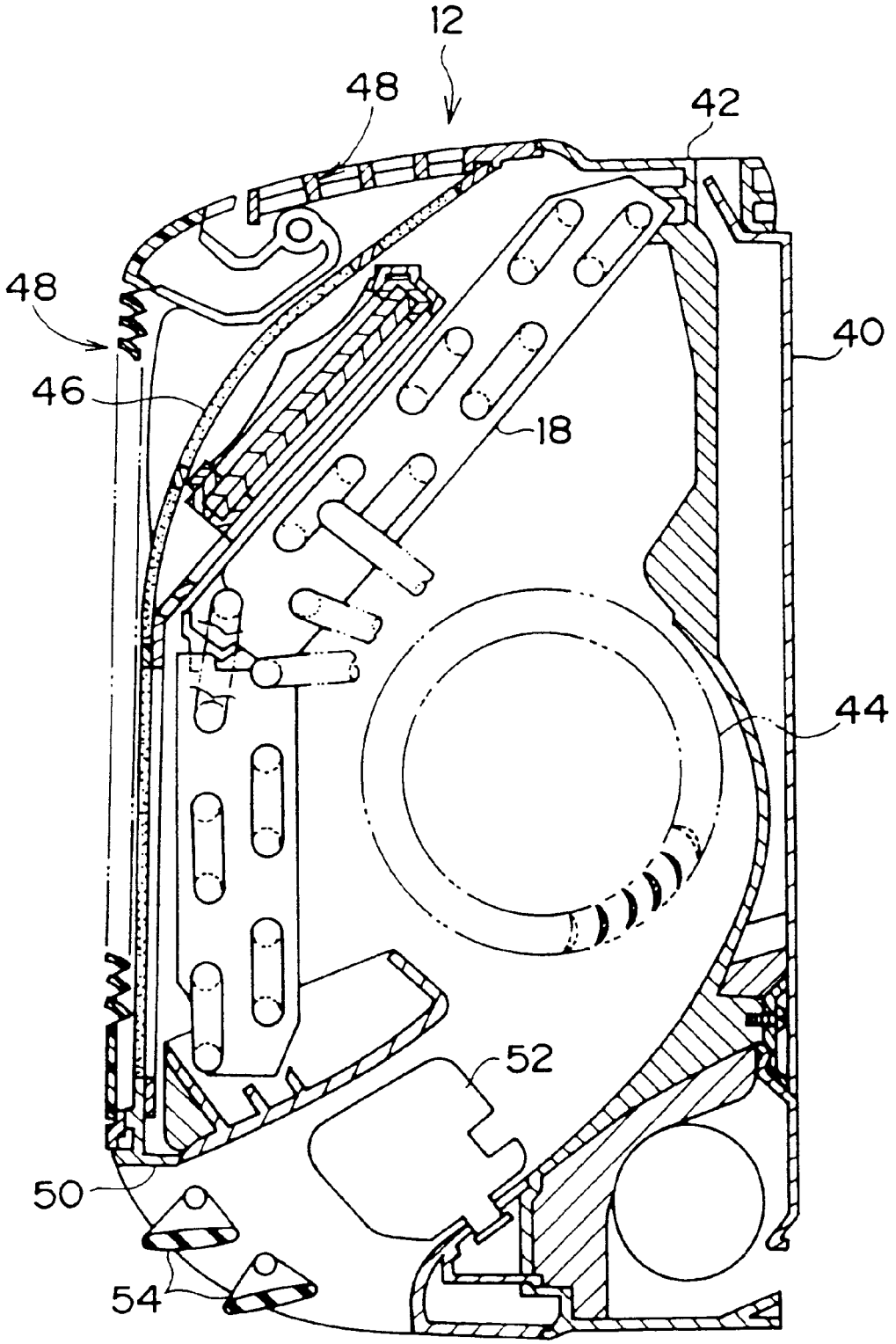
FIG. 3 is a schematic view illustrating an example of an interior structure of an interior unit of an air conditioner.

FIG. 3 shows a schematic sectional view of the interior unit 12. The interior portion of the interior unit 12 is covered by a casing 42 which is secured to the upper portion and the lower portion of a mounting base 40 (the portions at the top and bottom in FIG. 3) mounted on an unillustrated wall of the interior of the room. A cross flow fan 44 is disposed at the central portion of the casing 42. The heat exchanger 18 is disposed stretching from the front side to the top side of the cross flow fan 44. A filter 46 is disposed between the heat exchanger 18 and inlet openings 48 which are formed from the front side to the top side of the casing 42. Further, a blowout opening 50 is formed at the lower portion of the casing 42.

Thus, in the interior unit 12, the rotation of the cross flow fan 44 causes the interior air to be drawn into the inlet openings 48, to pass the filter 46 and the heat exchanger 18, and to be blown out from the blowout opening 50 to the interior of the room. When the air passes the heat exchanger 18 in the refrigerating cycle, it is heated or cooled by exchanging heat with the refrigerant. Then, the air is blown out as air-conditioned air from the blowout opening 50, thereby effecting air-conditioning of the interior of the room.

Vertical flaps 52 and horizontal flaps 54 are provided in the blowout opening 50 so that the direction in which the air-conditioned air is blown out can be adjusted by the vertical flaps 52 and the horizontal flaps 54.

As shown in FIG. 2, a fan 56 is provided in the exterior unit 14 so that the heat exchange running between outside air and the heat exchanger 30 is accelerated.

Figure 4:
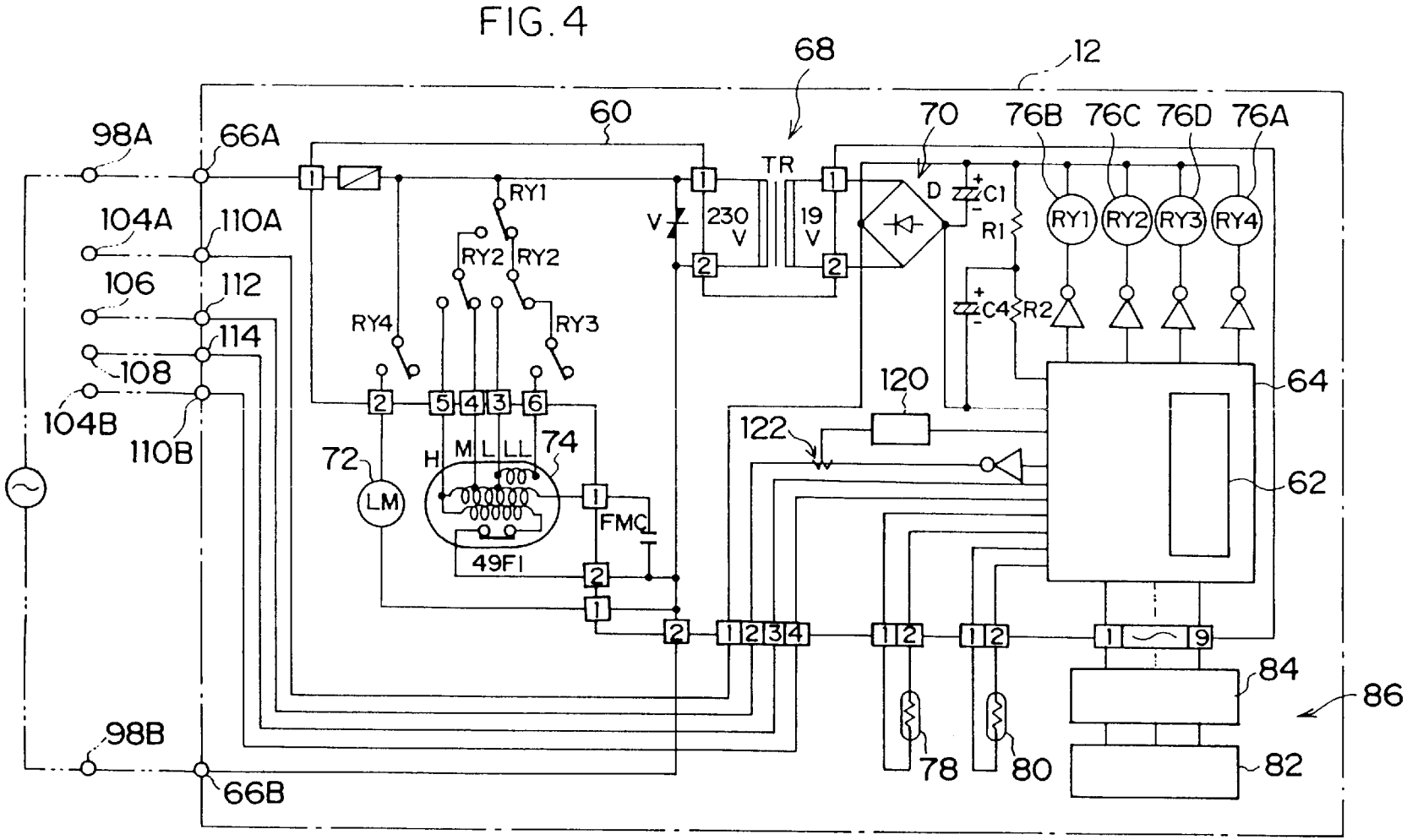
FIG. 4 is a schematic structural view illustrating a control board of an interior unit.

As shown in FIG. 4, in the interior unit 12, a control circuit 64 equipped with a microcomputer 62 is provided on a control board 60. Alternating current power is supplied to the control board 60 via terminals 66A and 66B. After being transformed by a power transformer 68, the alternating current power is rectified by a diode 70 so that a predetermined voltage of direct current (for example, DC 24V) is supplied to the control circuit 64.

A louver motor 72 for adjusting the direction of the horizontal flaps 54 and a fan motor 74 for driving the cross flow fan 44 are connected to the control board 60. A relay 76A for turning the louver motor 72 on and off and relays 76B, 76C and 76D for driving the fan motor 74 are connected to the control circuit 64.

The microcomputer 62 of the control circuit 64 adjusts the direction of the horizontal flaps 54 and swings the horizontal flaps 54 by driving the louver motor 72 using the on/off of the relay 76A. The microcomputer 62 of the control circuit 64 also controls the on/off of the cross flow fan 44 and the rotational frequency thereof in stages by switching on or off the relays 76B through 76D. Thus, the rotational frequency of the cross flow fan 44 is controlled in accordance with the four levels LL (faint wind), L (light wind), M (medium wind), and H (strong wind).

On the other hand, a heat exchanger temperature sensor 78 for detecting the temperature of the heat exchanger 18 and a room temperature sensor 80 for detecting the temperature of the air drawn in from the inlet openings 48 as the room temperature are provided in the interior unit 12. The heat exchanger temperature sensor 78 and the room temperature sensor 80 are connected to the control circuit 64.

Further, a display portion 86 equipped with a receiving board 82, for receiving an running signal from the remote controller 36, and a switch board 84 is provided in the interior unit 12. The switch board 84 of the display portion 86 is connected to the control circuit 64.

As shown in FIG. 1, the display portion 86 is provided in the casing 42 of the interior unit 12. By running the remote controller 36 with it pointed toward the display portion 86, the running signal transmitted from the remote controller 36 as an infrared signal is received by a receiving circuit 82. A run switching switch and various indication lamps using LED and the like are provided on the switch board 84, thereby giving indications such as the indication of the running (illustration omitted).

Figure 5:
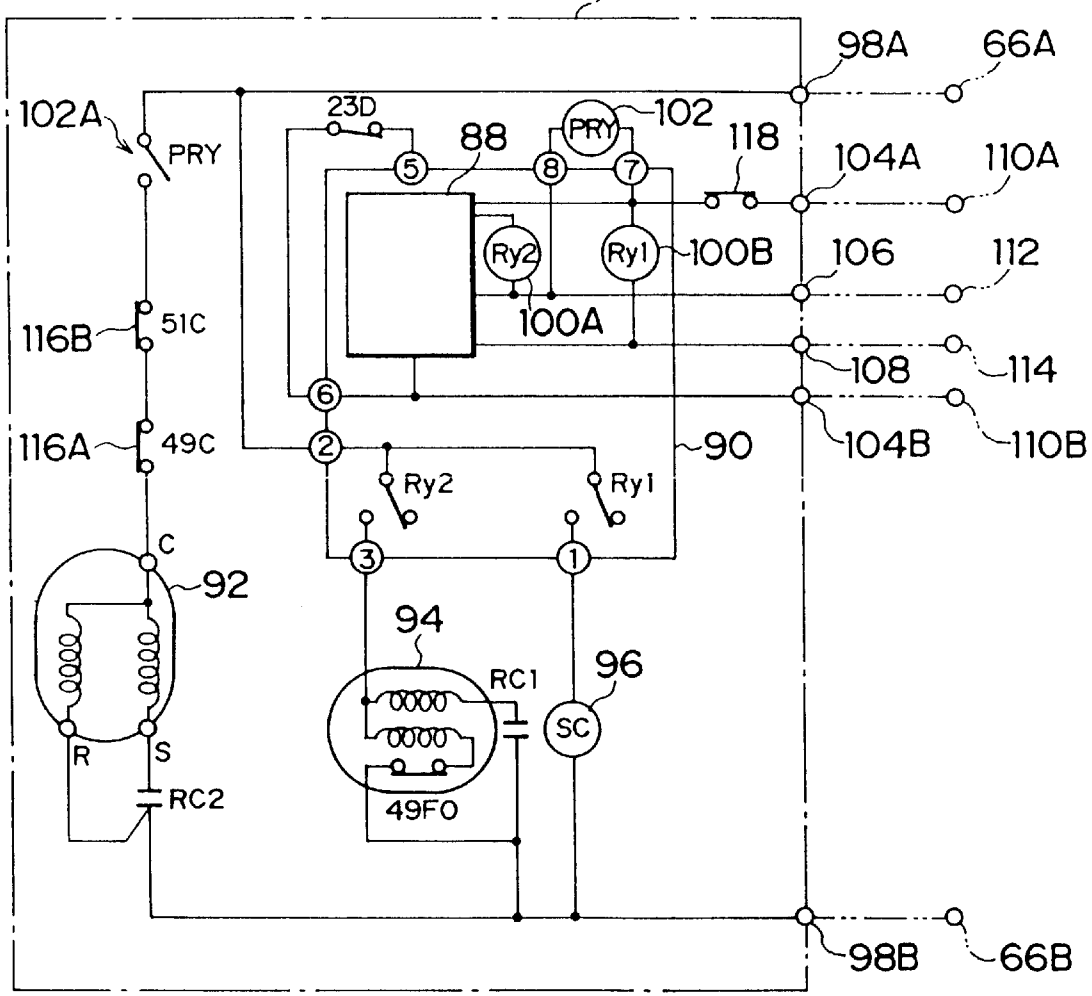
FIG. 5 is a schematic structural view illustrating a control board of an exterior unit.

On the other hand, as shown in FIG. 5, a control board 90 on which a control circuit 88 (protecting means) is provided, a compressor motor 92 for driving the compressor 26, a fan motor 94 for driving the fan 56 to rotate, and a solenoid 96 for switching the four-way valve 24 are provided in the exterior unit 14.

Alternating current power for running the compressor motor 92 is supplied to the exterior unit 14 by connecting terminals 98A and 98B to the terminals 66A and 66B of the interior unit 12. The compressor motor 92 (single-phase induction motor) drives the compressor 26 at a constant speed with the alternative current power.

Further, a relay 100A for driving the fan motor 94 and a relay 100B for driving the solenoid 96 are provided in the control circuit 88, and a power relay 102 for driving the compressor motor 92 is connected to the control circuit 88. The compressor motor 92 is driven when a contact point 102A is closed by carrying an electric current to the exciting coil of the power relay 102, and the fan motor 94 is driven when an electric current is supplied to the exciting coil of the relay 100A by the control circuit 88. The solenoid 96 switches the four-way valve 24 in accordance with the on/off of the relay 100B (in accordance with whether electric current is or is not being conducted).

The exterior unit 14 is connected to the control board 60 of the interior unit 12 via terminals 104A, 104B, 106 and 108. As shown in FIG. 4, terminals 110A, 110B, 112 and 114, to which the terminals 104A, 104B, 106 and 108 of the exterior unit 14 are connected, are connected to the interior unit 12, and are connected to the control board 60.

Direct current voltage (for example, DC 24V) is applied between the terminals 110A and 110B. Thus, as shown in FIG. 5, electric power for running is supplied from the control board 60 of the interior unit 12 to the control board 90 of the exterior unit 14.

Further, as shown in FIG. 4, the terminals 112 and 114 are connected to the control circuit 64, respectively. As shown in FIG. 5, the terminal 112 is connected to the power relay 102 and the control circuit 88 via the terminal 106 of the exterior unit 14, and the terminal 114 is connected to the relay 100B and the control circuit 88 via the terminal 108.

Thus, the control circuit 64 of the interior unit 12 not only controls opening or closing of contact points of the power relay 102 and the relay 100B of the exterior unit 14, in other words, the on/off of the compressor motor 92 and the switching of the four-way valve 24 but also inputs the control state to the control circuit 88.

The microcomputer 62 of the interior unit 12 not only controls the electric current to the exciting coil of the solenoid 96 in accordance with the running mode of the air conditioner 10 but controls the on/off of the compressor motor 92 in accordance with the difference between the room temperature and the set temperature so that desired air-conditioned air is blown out from the blowout opening 50 of the interior unit 12 for effecting air-conditioning of the interior of the room.

On the other hand, as shown in FIG. 5, contact points 116A and 116B are connected between the contact point 102A of the power relay 102 and the compressor motor 92 in the exterior unit 14. These contact points 116A and 116B are opened and closed by an unillustrated relay provided in the control circuit 88. These contact points 116A and 116B are usually closed so that electric current can be carried to the compressor motor 92. When the control circuit 88 detects an overload of the compressor motor 92 by unillustrated detecting means (the temperature of the compressor 26 or the current passing through the compressor motor 92), the contact point 116A is opened. When the control circuit 88 detects a decrease larger than the set value, at which sufficient heating cannot be carried out and which is set suitably in accordance with the capability of the compressor 26, in the outside air temperature by an unillustrated outside air temperature sensor during the heating, the contact point 116B is opened. When the contact point 116A or the contact point 116B is opened, the compressor motor 92 stops driving even if the power relay 102 is in a power-on state, thereby effecting protection of the compressor 26 and the like in the exterior unit 14.

Further, a contact point 118 is provided as protecting means between the terminal 104A and the power relay 102. The contact point 118 is usually closed. However, when the control circuit 88 opens either one of the terminals 116A and 116B, the control circuit 88 also opens the contact point 118. Thus, the power relay 102 is turned off. The overload of the compressor motor 92 and the outside air temperature can be detected by utilizing conventional techniques of the prior art, whose detailed description will be omitted in the present embodiment. Additionally, instead of the contact points 116A and 116B, the contact point 118 may be used for effecting protection of the compressor 26 and the like.

On the other hand, as shown in FIG. 4, an electric current detection circuit 120 is connected to the control board 60. A CT 122 for detecting the electric current that is flowing between the control circuit 64 and the terminal 112, in other words, the electric current that is passing through the power relay 102, is connected to the electric current detection circuit 120.

By turning on the power relay 102, an electric current with a predetermined value passes through an unillustrated coil of the power relay 102, and is detected by the CT 122. (A CT which detects DC or a shunt resistor may be used for the CT 122.) On the other hand, when the contact point 118 is opened, the electric current is unable to pass through the coil of the power relay 102, thereby decreasing the current value detected by the CT 122. The electric current detection circuit 120 outputs to the control circuit 64 as to whether or not the current value being detected by the CT 122 is equal to or less than the predetermined value.

The microcomputer 62 of the control circuit 64 runs the power relay 102. The electric current detection circuit 120 determines that the power relay 102 is in a power-off state when the electric current being detected by the CT 122 is equal to or less than the predetermined value. It is at this point that the microcomputer 62 determines that the compressor motor 92 is stopped due to the occurrence of the abnormality in the exterior unit 14.

In the meantime, the microcomputer 62 of the control circuit 64 provided in the interior unit 12 firstly turns on the compressor 26 when the start of the heating is instructed. Then, while detecting the temperature of the heat exchanger 18 by the heat exchanger temperature sensor 78, the microcomputer 62 controls the cross flow fan 44 on the basis of the detection result. When the temperature of the heat exchanger 18 is less than a predetermined temperature (for example, 35° C.), the cross flow fan 44 is rotated at a low rotational frequency. After the temperature has reached the predetermined temperature, the microcomputer 62 subsequently controls the rotational frequency of the cross flow fan 44 on the basis of the difference between the room temperature and the set temperature.

On the other hand, when the temperature of the heat exchanger 18 goes down, the microcomputer 62 again decreases the rotational frequency of the cross flow fan 44 in accordance with the temperature of the heat exchanger 18 so that cold air or air that is felt to be cold is prevented from being blown out from the interior unit 12 during the heating.

Running of the present embodiment will be described hereinafter.

When the air-conditioning is instructed by the running of the remote controller 36, the constant-speed type air conditioner 10 which runs the compressor 26 at a constant speed effects an air-conditioning firstly by energizing the exciting coil of the solenoid 96 with the running of either the cooling mode or the heating mode so that the four-way valve 24 is switched in accordance with the running mode set by the remote controller 36 and secondly by turning the compressor 26 on and off in accordance with the set temperature, the room temperature, and the like.

In the meantime, the control circuit 88 provided in the exterior unit 14 detects the load of the compressor motor 92 (for example, the driving electric current), the outside air temperature and the like when the electric power for running is inputted from the control board 60 of the interior unit 12. Then, for example, when the temperature of the heat exchanger 30 has risen during the cooling, the control circuit 88 runs the fan motor 94 so as to cool down the heat exchanger 30.

Further, the control circuit 88 opens the contact points 116A and 118 when the compressor motor 92 is loaded more than required, and opens the contact points 116B and 118 when it is detected that the outside air temperature is greatly decreased during the heating and thus the heating capability cannot be performed sufficiently. In other words, the control circuit 88 opens the contact point(s) 116A and/or 116B so as to stop the compressor motor 92 when an abnormality occurs in the exterior unit 14 or an abnormality occurs in the running environment of the exterior unit 14. At this point, the contact point 118 is opened together with the contact point(s) 116A and/or 116B.

On the other hand, by utilizing the CT 122 and the electric current detection circuit 120, the microcomputer 62 provided in the control circuit 64 of the interior unit 12 is detecting whether or not the running of the compressor 26 is stopped due to the occurrence of abnormality in the exterior unit 14.

Figure 6:
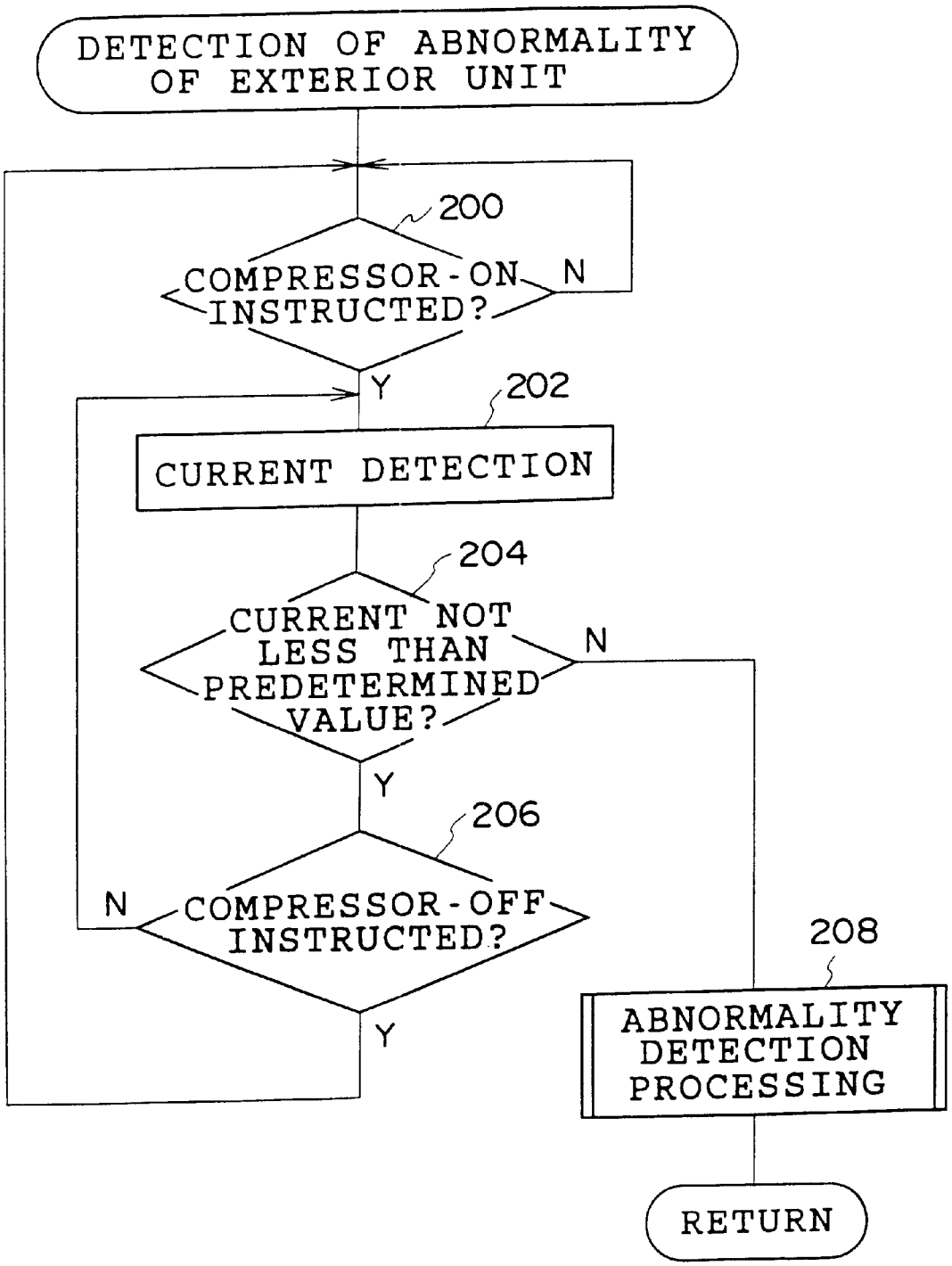
FIG. 6 is a flow chart illustrating an example in which an abnormality of an exterior unit is detected in an interior unit.

FIG. 6 shows an example in which abnormality of the exterior unit is detected by the control circuit 64 (the microcomputer 62) of the interior unit 12. The processing represented by the flow chart is carried out when the air conditioner 10 starts the air-conditioning, and i s terminated when the air conditioner 10 stops.

In the flow chart shown in FIG. 6, when the air conditioner 10 starts to operate, the first step, i.e. step 200 determines whether or not the instruction to turn on the compressor 26 is given.

In turning on the compressor 26, the control circuit 64 applies a predetermined voltage between the terminals 100A (104A) and 112 (106). Thus, in the exterior unit 14, the power relay 102 is turned on and the contact point 102A is closed so that the electric power for driving is supplied to the compressor motor 92. By turning on the power relay 102, the answer to the determination in step 200 is "Yes" and the routine moves to step 202.

In step 202, the electric current passing through the coil of the power relay 102 is detected by the CT 122. In subsequent step 204, a determination is made as to whether the current value being detected by the CT 122 is equal to or larger than the predetermined value in the electric current detection circuit 120.

At this point, as the power relay 102 is run by the voltage outputted from the control circuit 64, the current value detected by the CT 122 is equal to or larger than the predetermined value. Therefore, the answer to the determination in step 204 is "Yes".

In the subsequent step, i.e. step 206, a determination is made as to whether the instruction to turn off the compressor 26 is given. Until the instruction to turn off the compressor 26 is given (the answer to the determination in step 206 is "No"), the electric current is repeatedly detected by the CT 122. When the power relay 102 is turned off so as to turn off the compressor 26, the answer to the determination in step 206 is "Yes", and the routine returns to the first step, i.e. step 200.

At this point, when an abnormality occurs in the exterior unit 14, the control circuit 88 of the exterior unit 14 opens at least one of the terminals 116A and 116B. Thus, the compressor motor 92 is stopped so that the compressor 26, the heat exchanger 30, and the like are protected.

On the other hand, in opening the contact point(s) 116A and/or 116B, the control circuit 88 also opens the contact point 118 so that the power relay 102 is turned off. When the power relay 102 is turned off, the value of the electric current detected by the CT 122 is lowered to a value equal to or less than the predetermined one.

Thus, in the flow chart illustrated in FIG. 6, the answer to the determination in step 204 is "No", and the routine moves to step 208 where the abnormality detection processing is carried out.

In other words, the microcomputer 62 provided in the interior unit 12 determines that the occurrence of an abnormality in the exterior unit 14 has forced the power relay 102 to be turned off regardless of the instruction to turn on the power relay 102.

In this way, when the compressor 26 is turned on or off by the power relay 102 provided in the exterior unit 14 being turned on or off so that the compressor 26 is stopped for protection of equipment in the exterior unit 14, the stopping of the running of the compressor 26 can be detected easily and certainly by providing protecting means for turning off the power relay 102 and by detecting the electric current during the power-on state of the power relay 102.

Subsequently, as running of the present embodiment, prevention of cold air from being blown out during the heating will be described with reference to a flow chart shown in FIG. 7. In the following description, as shown in FIG. 8, when the temperature of the heat exchanger 18 is rising, the stopped state of the cross flow fan 44 is switched to the running with faint wind (LL) at a temperature T1 (for example, 25° C.). The running with faint wind is switched to the running with a set air at a temperature T2 (for example, 35° C.). On the other hand, when temperature t of the heat exchanger 18 is decreasing in spite of the instruction to operate the compressor 26, the running with the set air amount is switched to the running with faint wind at a temperature T3 (for example, 25° C., in the present embodiment, for example, t=T1=T3). Further, when the temperature t goes down below T4 (for example, 20° C.), blowing is stopped.

Figure 7:
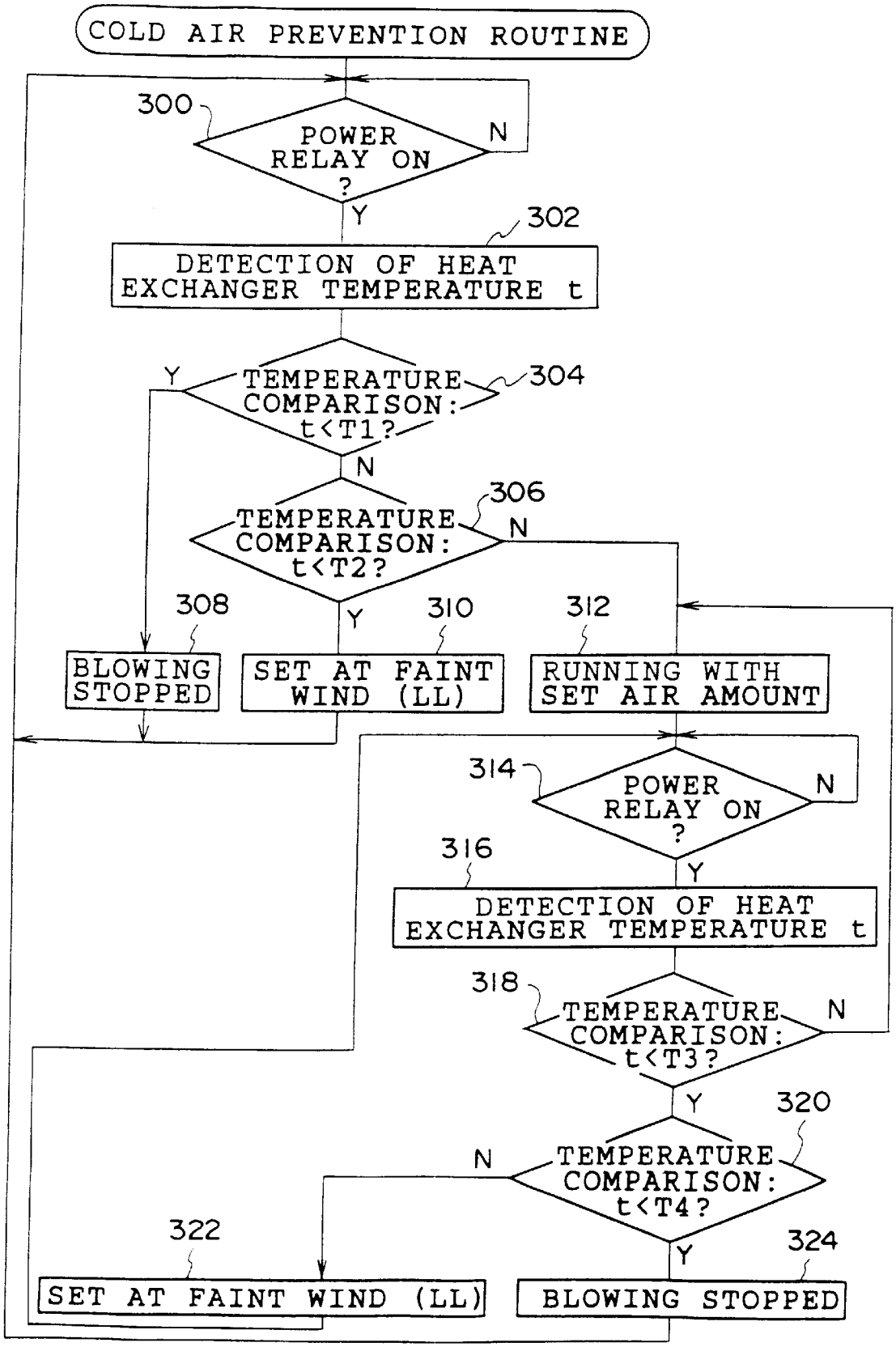
FIG. 7 is a flow chart illustrating an example of preventing cold air being blown out during a heating.
Figure 8:
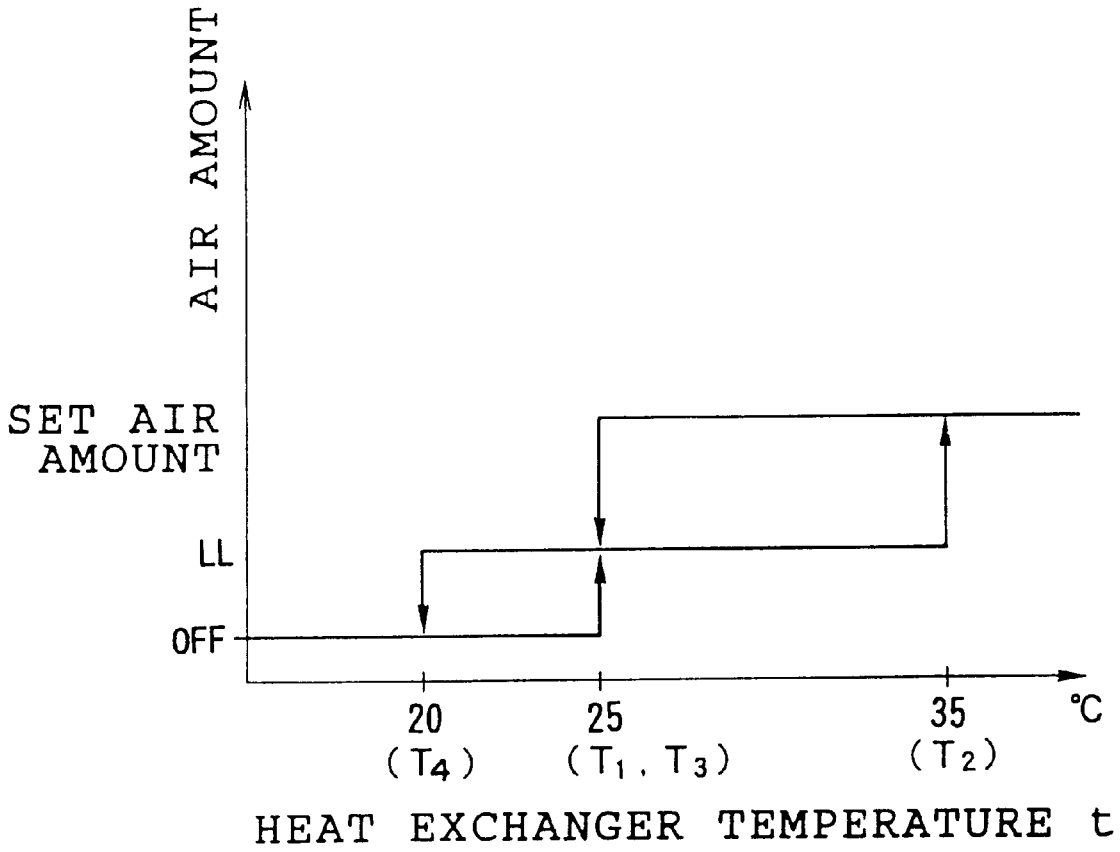
FIG. 8 is a chart illustrating set stages of air amounts for temperatures of a heat exchanger according to the present invention.

The processing represented by the flow chart shown in FIG. 7 is carried out when the air conditioner 10 starts to operate after the air conditioner 10 is set to a heating mode by the running of the remote controller 36, and the processing stops when the running at the heating mode is terminated.

In the flow chart, the first step, i.e. step 300 determines whether or not a signal for turning on the power relay 102 is outputted so as to operate the compressor 26, and when the power relay 102 is in a power-on state (the answer to the determination in step 300 is "Yes"), the routine moves to step 302 where the temperature t of the heat exchanger 18 is detected by the heat exchanger temperature sensor 78 at a predetermined timing.

Subsequently, in the steps 304 and 306, the temperature t is compared with the predetermined temperatures T1 and T2. As the temperature T1 and the temperature T2 are set relatively high, the temperature t of the heat exchanger 18 at the start of the heating is naturally lower than the temperature T2 and is often lower than the temperature T1. In that case, the answer to the determination in step 304 is "Yes", and the routine moves to step 308 where the fan motor 74 is kept stopped.

On the other hand, when the compressor 26 (a compressor motor 92) of the exterior unit 14 is running normally, the temperature of the heat exchanger 18 is increased by the refrigerant circulated in the refrigerating cycle. Thus, when the temperature t of the heat exchanger 18 does not reach to the temperature T2 but exceeds the temperature T1, the answer to the determination in step 304 is "No", but the answer to the determination in step 306 is "Yes", and the routine moves to step 310. In step 310, the driving of the fan motor 74 is set in such a manner that the amount of air blown by the cross flow fan 44 is faint wind (LL).

Further, when the temperature t of the heat exchanger 18 goes up and exceeds the temperature T2 (the answers to the determination in steps 304 and 306 are "No"), the routine moves to step 312 where the fan motor 74 is driven in such a manner that the air amount is, for example, the one set by the remote control switch 36.

Thus, at the start of the heating, the fan motor 74 is stopped until the temperature t of the heat exchanger 18 reaches to the temperature T1. Then, the fan motor 74 is driven in such a manner that the air amount is faint wind (LL) while the temperature t of the heat exchanger 18 is higher than the temperature T1 but not higher than the temperature T2. It is not until the temperature t of the heat exchanger 18 exceeds the temperature T2 that the air-conditioning with an air amount set by the remote control switch 36 is started.

On the other hand, when the air amount to be blown reaches the set air amount, the routine moves to step 314 where a determination is made as to whether the power-on state of the power relay 102 is maintained. If the power relay 102 is maintained in the power-on state (the answer to the determination in step 314 is "Yes"), the routine subsequently moves to step 316 where the temperature t of the heat exchanger 18 is detected so that the temperature t is compared with the predetermined temperatures, i.e. T3 (in the present embodiment, T3=T1) and T4. When the compressor 26 is turned off (the power relay 102 is turned off), the running of the cross flow fan 44 is controlled, for example, by the control routine which is set independently, such as the control for detecting the appropriate room temperature by the temperature sensor 80.

At this point, if the temperature t is kept equal to or higher than the temperature T3, the answer to the determination in step 318 is "No", and the blowing with a set amount of air is continued.

Contrary to this, if the running of the compressor 26 is stopped by the running of the protecting means of the exterior unit 14 though the microcomputer 62 of the interior unit 12 tries to turn on the power relay so as to operate the compressor 26, the refrigerant stops circulating in the heat exchanger 18. Then, if the blowing is continued, the temperature t of the heat exchanger 18 goes down.

Thus, when the temperature t of the heat exchanger 18 goes down to be lower than the temperature T3, the answer to the determination in step 318 is "Yes". At this point, when the temperature t is equal to or higher than the temperature T4, the answer to the determination in step 320 is "No", and the routine moves to step 322 where the rotational frequency of the fan motor 74 is set in such a manner that the air amount is faint wind.

In other words, the temperature of the heat exchanger 18 goes down when the exterior unit 14 stops the running of the compressor 26 (the compressor motor 92) even if the interior unit 12 tries to operate the compressor 26. Thus, if the blowing is continued, not only does the temperature t of the heat exchanger 18 drop further but cold air is also blown out from the blowout opening 50 of the interior unit 12.

Contrary to this, by running the cross flow fan 44 in such a manner that the air amount blown therefrom is restrained, not only can the lowering of the temperature t of the heat exchanger 18 be restrained but can the air-conditioned air that is not warm (air that feels cold) can be prevented from being blown out from the blowout opening 50.

On the other hand, if the temperature t of the heat exchanger 18 goes down further to be equal to or lower than the temperature T4 in spite of the running with the restrained air amount, the answer to the determination in step 320 is "Yes" and the routine moves to step 324. The step 324 stops the fan motor 74 and prevents cold air from being blown out from the blowout opening 50.

In this way, when the temperature t of the heat exchanger 18 which had previously risen reaches a temperature that is impossible for the heating, the blowing is stopped. Therefore, prevention of cold air from being blown out from the blowout opening 50 is ensured even when the temperature t of the heat exchanger 18 drops due to the stopping of the running of the compressor 26 without the stopping of the compressor being directly detected by the protecting means.

Further, when the fan motor 74 has been, the routine returns to step 300 where the same processing is effected as at the start of the heating. Thus, when the running of the compressor 26 is resumed, prevention of cold air from being blown out from the blowout opening is ensured. Otherwise, cold air will be blown out as the air amount to be blown is not restrained despite the relatively low temperature t of the heat exchanger 18.

The structure of the present invention is not limited to the air conditioner 10 applied to the present embodiment. The present invention can be applied to an air conditioner with any structure, and can be applied to what is called a separate type air conditioner which is divided into the interior unit and the exterior unit and a constant-speed type air conditioner which drives the compressor at a constant speed.

Further, any temperatures can be used for the temperatures T1, T2, T3, and T4 that are applied to the present embodiment if they are set in such a manner that cold air will not be blown out from the interior unit 12. In addition, in the present embodiment, the temperature T1 and the temperature T3 are the same temperature, yet the temperature T1 and the temperature T3 may be different temperatures.

As described above, according to the present invention, an excellent effect can be obtained in that an abnormality of the exterior unit can be detected without fail with a simple structure which not only detects the electric current on the interior unit side when the electric current is carried to the power relay but also interrupts the electric current carried to the power relay when the protecting means is run on the exterior unit side.

What is claimed is:

1. A controller for an air conditioner for heating or cooling air in a room, said air conditioner comprising a constant-speed type compressor, an exterior heat exchanger adapted to be provided outside the room, an expansion device, and an interior heat exchanger adapted to be provided in the room, to circulate a refrigerant in this order for cooling or in the reverse order for heating, wherein the compressor, the exterior heat exchanger, and the pressure reducer form an exterior unit, and the interior heat exchanger forms an interior unit, said controller comprising:

a power relay including an exciting coil provided with a contact point to inactivate or activate the compressor when the contact point opens or closes, the opening and closing of the contact point being controlled by electric current passing through the exciting coil;

an electric current detector for detecting the electric current passing through the exciting coil;

a control circuit for detecting the occurrence of a predetermined abnormality in the exterior unit based on a difference between a value of the electric current detected by the current detector and a predetermined value; and a protector for discontinuing electric current passing through the exciting coil when the predetermined abnormality is detected by the control circuit.

2. A controller according to claim 1, wherein the protector comprises a load detector for detecting a load of the compressor.

3. A controller according to claim 2, wherein the electric current passing through the exciting coil is designed to change if the load detector detects an overload of the compressor, whereby the control circuit determines the occurrence of the abnormality in the exterior unit.

4. A controller according to claim 1, wherein the protector comprises an outside air temperature detector for detecting an outside air temperature.

5. A controller according to claim 4, wherein the electric current passing through the exciting coil is designed to change if the outside air temperature detector detects a decrease in outside air temperature to a predetermined degree or greater during heating, whereby the control circuit determines the occurrence of the abnormality in the exterior unit.

6. A controller according to claim 1, wherein the electric current passing through the exciting coil is designed to change if the electric current detects an electric current equal to or less than a predetermined value, whereby the control circuit determines the occurrence of the abnormality in the exterior unit.

7. An air conditioner for heating or cooling air in a room, comprising:

(A) a refrigerant circuit comprising: a constant-speed type compressor, an exterior heat exchanger adapted to be provided outside the room, an expansion device, and an interior heat exchanger adapted to be provided in the room, to circulate a refrigerant in order for cooling or in the reverse order for heating, wherein the compressor, the exterior heat exchanger, and the pressure reducer form an exterior unit, and the interior heat exchanger forms an interior unit; and (B) a controller comprising:

a power relay including an exciting coil provided with a contact point to inactivate or activate the compressor when the contact point opens or closes, the opening and closing of the contact point being controlled by electric current passing through the exciting coil;

an electric current detector for detecting the electric current passing through the exciting coil;

a control circuit for detecting the occurrence of a predetermined abnormality in the exterior unit based on a difference between a value of the electric current detected by the current detector and a predetermined value; and a protector for discontinuing electric current passing through the exciting coil when the predetermined abnormality is detected by the control circuit.

8. A method for controlling an air conditioner for heating or cooling air in a room, said air conditioner comprising:

a refrigerant circuit comprising: a constant-speed type compressor, an exterior heat exchanger adapted to be provided outside the room, an expansion device, and an interior heat exchanger adapted to be provided in the room, to circulate a refrigerant in order for cooling or in the reverse order for heating, wherein the compressor, the exterior heat exchanger, and the pressure reducer form an exterior unit, and the interior heat exchanger forms an interior unit; and a power relay including an exciting coil provided with a contact point to inactivate or activate the compressor when the contact point opens or closes, the opening and closing of the contact point being controlled by electric current passing through the exciting coil;

said method comprising the steps of:

detecting the electric current passing through the exciting coil;

detecting the occurrence of a predetermined abnormality in the exterior unit based on a difference between a value of the detected electric current and a predetermined value; and opening or closing the contact point of the power relay in accordance with electric current passing through the exciting coil of the power relay, wherein the electric current passing through the exciting coil is discontinued when the predetermined abnormality is detected.

9. A method according to claim 8, wherein the electric current passing through the exciting coil is changed if the load detector detects an overload of the compressor, whereby the control circuit determines the occurrence of the abnormality in the exterior unit.

10. A method according to claim 8, wherein the electric current passing through the exciting coil is changed if the outside air temperature detector detects an decrease in outside air temperature to a predetermined degree or greater during heating, whereby the control circuit determines the occurrence of the abnormality in the exterior unit.

11. A method according to claim 8, wherein the electric current passing through the exciting coil is changed if the electric current detects an electric current equal to or less than a predetermined value, whereby the control circuit determines the occurrence of the abnormality in the exterior unit.

* * * * *